US005836658A

United States Patent [19]

Mraz

[11] Patent Number: 5,836,658

[45] Date of Patent: Nov. 17, 1998

[54] METHOD AND APPARATUS FOR BORING AND SHEARING OF ROCKS

[76] Inventor: Dennis Mraz, 410 Jessop Avenue, Saskatoon, Saskatchewan, Canada, S7N 2S5

[21] Appl. No.: 709,941

[22] Filed: Sep. 6, 1996

[51] Int. Cl.[6] ..... E21C 27/18

[52] U.S. Cl. ..... 299/60; 299/80.1; 299/75

[58] Field of Search ..... 299/10, 60, 73, 299/75, 80.1, 61

[56] References Cited

U.S. PATENT DOCUMENTS

| | | | |
|---|---|---|---|
| 2,920,879 | 1/1960 | Driehaus | 299/64 |
| 3,306,663 | 2/1967 | Webster | 299/61 X |
| 4,159,149 | 6/1979 | Castanoli et al. | 299/80.1 |
| 4,596,424 | 6/1986 | Wilcox, Jr. et al. | 299/64 |
| 4,749,194 | 6/1988 | Schmid | 299/75 X |
| 4,848,844 | 7/1989 | Weiss | 299/55 |

FOREIGN PATENT DOCUMENTS

| | | |
|---|---|---|
| 1185140 | 1/1965 | Germany . |
| 2027192 | 2/1972 | Germany . |
| 2124407 | 2/1984 | United Kingdom . |

*Primary Examiner*—David J. Bagnell
*Attorney, Agent, or Firm*—Morgan & Finnegan L.L.P.

[57] ABSTRACT

A method of rock cutting where, as a first step of each excavation cycle, a second open surface is created utilizing boring method and, as a second step, the excavation cycle is completed utilizing a shearing method; and a cutting element for excavation of rocks comprising both a boring tool and a shearing tool, wherein the cutting element can be remotely adapted either for boring or for shearing.

10 Claims, 7 Drawing Sheets

METHOD AND APPARATUS FOR BORING AND SHEARING OF ROCKS

FIELD OF THE INVENTION

The present invention relates generally to excavating rock and mineral formations and specifically to excavating underground headings.

DESCRIPTION OF THE RELATED ART

Current devices for excavating rock and mineral formations in underground headings can be classified as: borers, shearers, drum miners or roadheaders.

In machines called borers, boring cutters are rotated while advancing into the heading, creating openings of substantially constant circular or semicircular cross sections. Although borers are efficient and productive, their utilization is restricted to applications where there is no need to substantially vary the size or shape of the headings.

Machines using rock shearing are called shearers. Rock shearing is slicing rock layers of a relatively uniform thickness toward an open face and it require at least two open rock surfaces prior to the commencement of excavation. Although shearing method is more efficient than other means of excavating, shearers are utilized chiefly in long wall mining, where the second rock surface is prepared by other means before the shearing operation can start.

In tunnels and other similar underground headings, only one face is available. For this reason, various universal cutting tools have been devised. In drum miners a rotating horizontal or vertical drum is forced into the face of a heading in an operation called sumping. In roadheaders, the cutting tool is a blunt semi-spherical or conical instrument. See UK Patent No. 2,124,407A, by Zollman & Doyle, German Patent No. 1,185,140, by Blotenberg, et al. and German Patent No. 2,027,192, by Andrejewski and Honke. Once the cutting tool has been advanced sufficiently into the face, shearing commences either horizontally or vertically. Because these cutters must perform both the sumping and the shearing, they are neither boring nor shearing tools. Rather, they constitute an inefficient compromise between the two.

Driehaus, U.S. Pat. No. 2,920,879, and Wilcox, Jr., et al., U.S. Pat. No. 4,596,424, attempted to overcome this problem by utilizing twin augers for boring, followed with side cutting. Again, such tools are constructed as a compromise in order to perform both of these operations. Moreover, side cutting with augers is far less efficient than shearing with a properly constructed shearing drum.

SUMMARY OF THE INVENTION

An object of the present invention is therefore to provide a method of rock cutting, where only boring is first performed to provide the second rock face in a heading, and then, only shearing follows.

Another object of the present invention is to provide a rock cutting tool capable of independently boring as a boring tool, and independently shearing as a shearing tool, without compromising efficiency of either operation.

Another object of the present invention is to provide a means for remotely converting the cutting tool in such a way that it is capable of automatically maintaining itself in a fixed position, with respect to the base plane of the mining machine, while the tool is being moved through all the positions of the required cutting sequence, in order to achieve either efficient boring or efficient shearing.

These and other objects of the present invention are met by a method according to which means for rock cutting is first used to perform exclusively a boring operation and subsequently exclusively a shearing operation, said means of rock cutting consisting of means for boring and means for shearing independent from one another; and means for engaging boring means during the boring operation and disengaging it during the shearing operation.

DETAILED DESCRIPTION OF THE PREFERRED EMBODIMENTS

FIGS. 1(*a*) through 1(*f*) schematically illustrate a method of rock cutting according to present invention. The boring is accomplished in the first step, corresponding to FIG. 1(*a*), by configuring the cutting elements 10 for boring and maintaining them in a fixed position with respect to the heading 1 while advancing them into the face 2 of the heading 1. When the cutting elements are advanced a predetermined distance into the face 2, the cutting elements are re-configured for shearing. FIGS. 1(*b*) through 1(*f*) illustrate cutting steps required to excavate the whole area of face 2 by shearing. On completion of the last step as per FIG. 1(*f*), the cutting elements 10 are again moved into a boring position illustrated in FIG. 1(*a*) and re-configured for boring. Although FIG. 1(*a*) illustrates boring at the top of the heading 1, other boring positions of cutting elements 10 in the face 2 are possible with subsequent shearing sequence suitably modified.

Figure 1A:
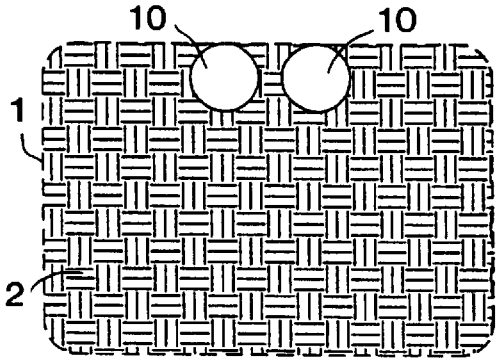
FIGS. 1(*a*) through 1(*f*) are front views showing schematically a method of rock cutting according to the present invention.
Figure 1D:
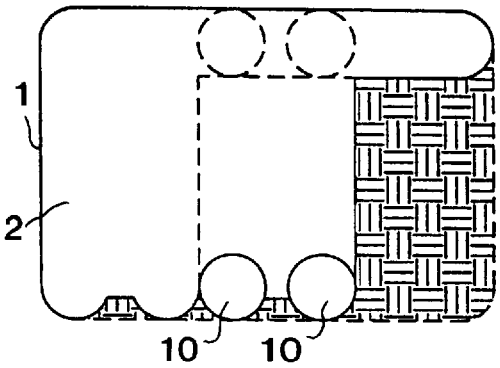
Figure 1B:
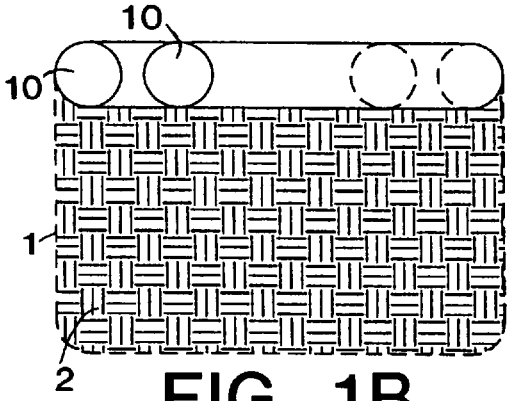
Figure 1E:
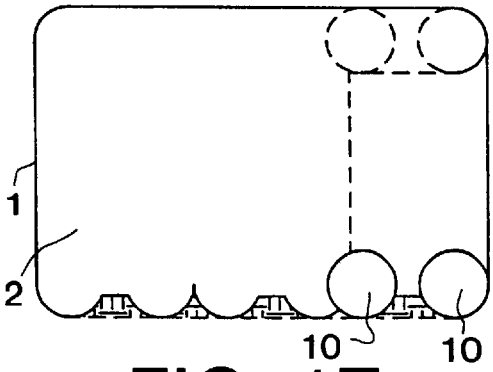
Figure 1C:
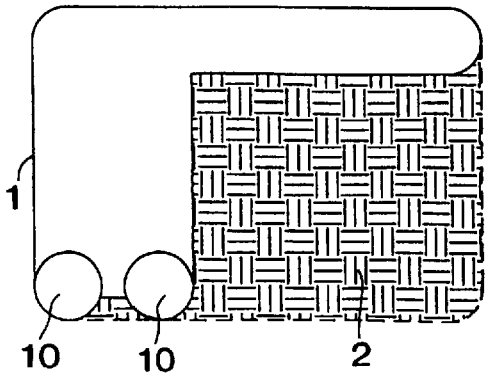
Figure 1F:
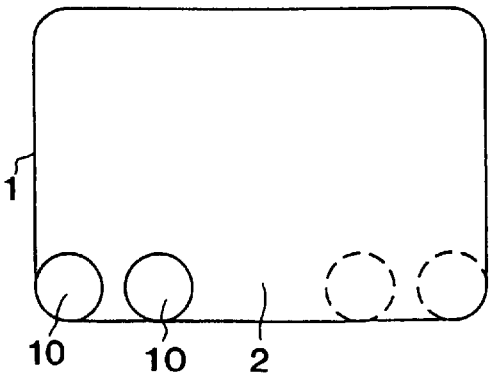
Figure 2B:
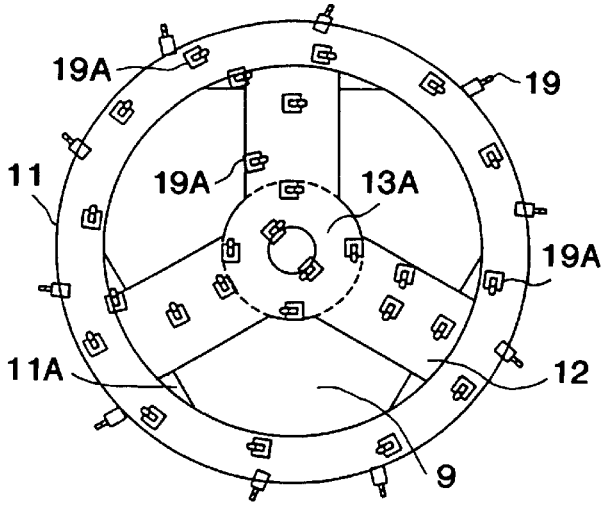
FIGS. 2(*a*) through 2(*c*) are side views and a front view of the preferred embodiment of the rock cutting tool according to the present invention.
Figure 2A:
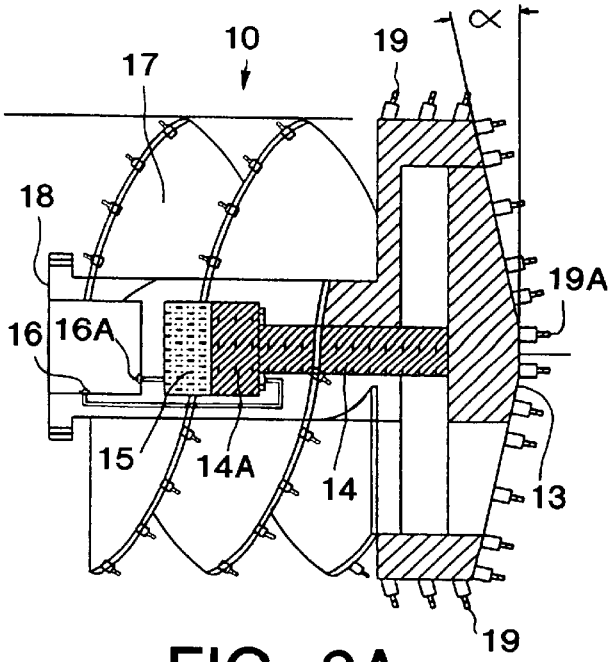
Figure 2C:
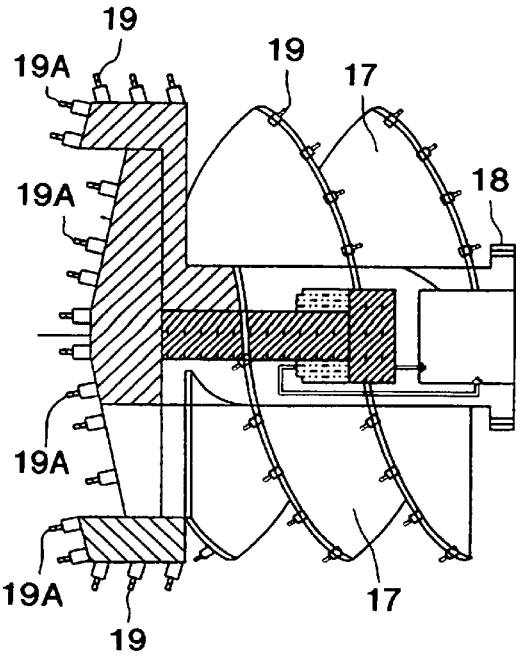

The side view cross section of a preferred embodiment of a cutting element with a boring tool engaged is illustrated in FIG. 2(*a*) and the front view is shown in FIG. 2(*b*). The cutting element 10 consists of a shearing ring 11 and one or more helical shearing flights 17 mounted on a barrel 18. Cutting bit assemblies 19 are mounted on the periphery of the shearing ring 11 and the helical shearing flights 17. A boring tool 13 consists of a core cutter 13*a*, three boring arms 12, a piston rod 14 and a hydraulic piston 14*a* located within the hydraulic cylinder 15 of the cutting element 10. The boring arms 12 are guided by guides 11*a* within the shearing ring 11. Cutting bit assemblies 19*a* are mounted on the face of the core cutter 13*a* and boring arms 12. Hydraulic ports 16 and 16*a* are provided for the operation of the piston

14*a* within the cylinder 15. When the piston 14*a* is located in a forward position as shown in FIG. 2(*a*), the boring tool 13 is engaged and the cutting element 10 is configured for a boring operation. As the cutting tool 10 is rotated and advanced, bit assemblies 19*a* bore out rock which passes through openings 9 to the helical flights 17 which extract rock cuttings toward the rear of the barrel 18.

The side view cross section of a preferred embodiment of a cutting element with a boring tool 13 disengaged is illustrated in FIG. 2(*c*) with the piston 14*a* located in a rearward position and the cutting element 10 configured for a shearing operation. In this configuration the boring tool 13 is retracted inside the shearing ring 11 and the cutting bit assemblies 19*a* are not in contact with rock to assure no interference with the shearing operation. The magnitude of the angle $\alpha$ depends on the hardness of the rock. The harder the rock, the lower the angle $\alpha$.

Figure 3B:
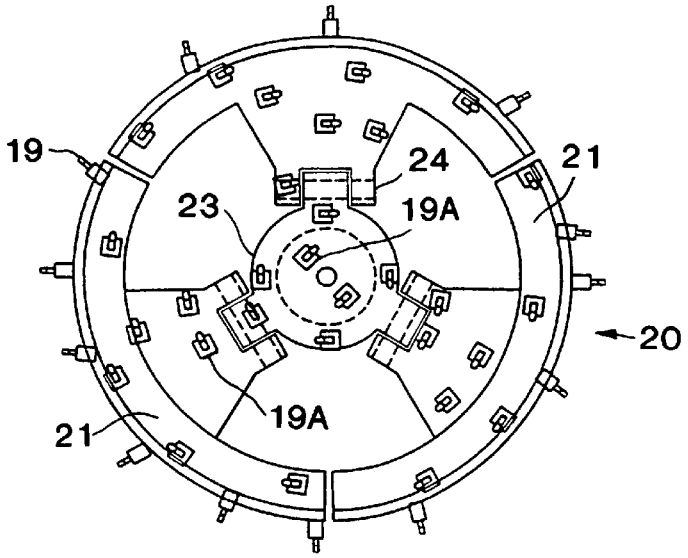
FIGS. 3(*a*) through 3(*c*) are side views and a front view of another embodiment of the rock cutting tool according to the present invention.
Figure 3A:
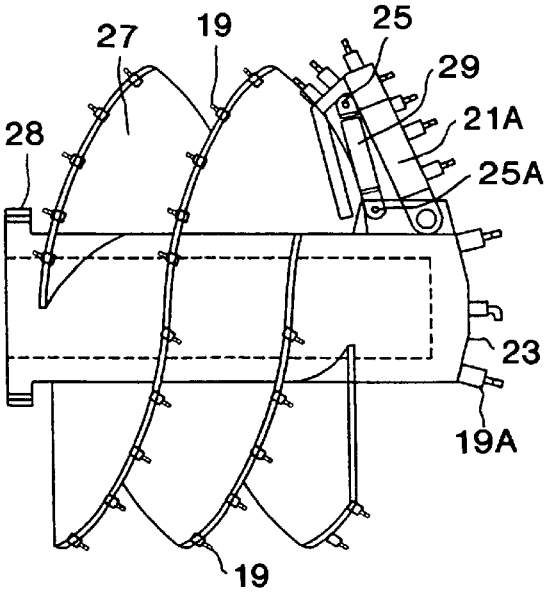
Figure 3C:
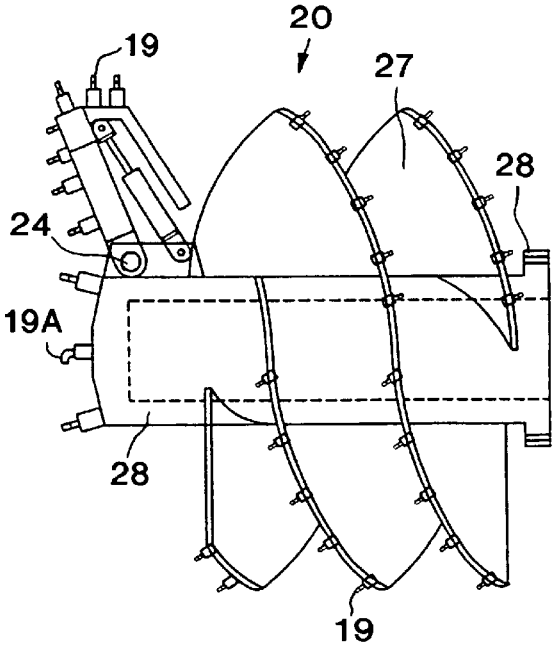
Figure 4:
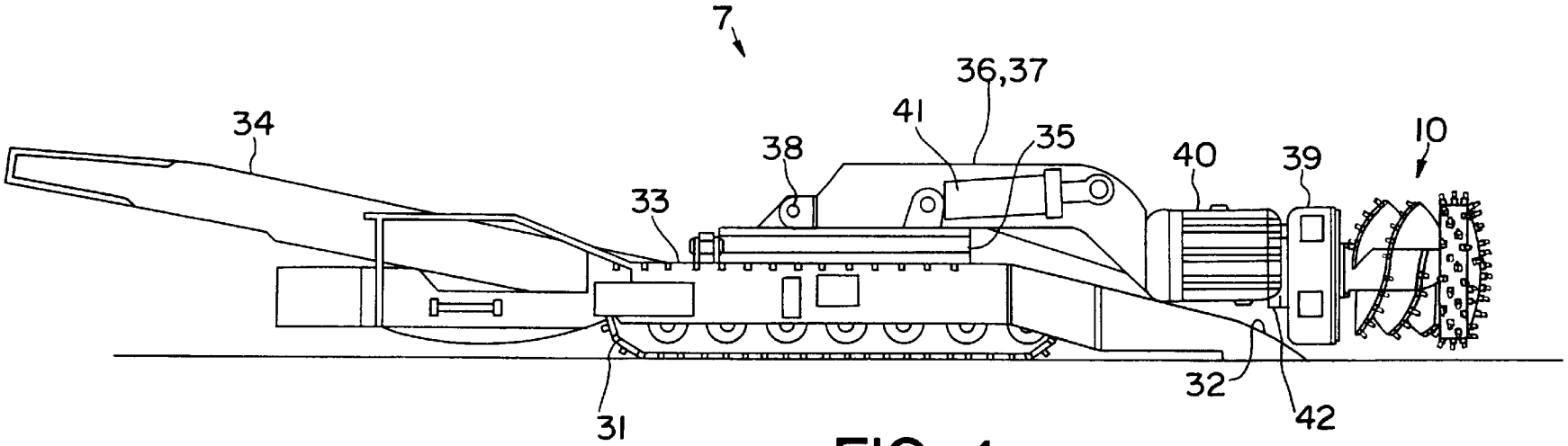
FIG. 4 is a side view showing the cutting tool together with mounting means according to the present invention on a typical mining machine.
Figure 5:
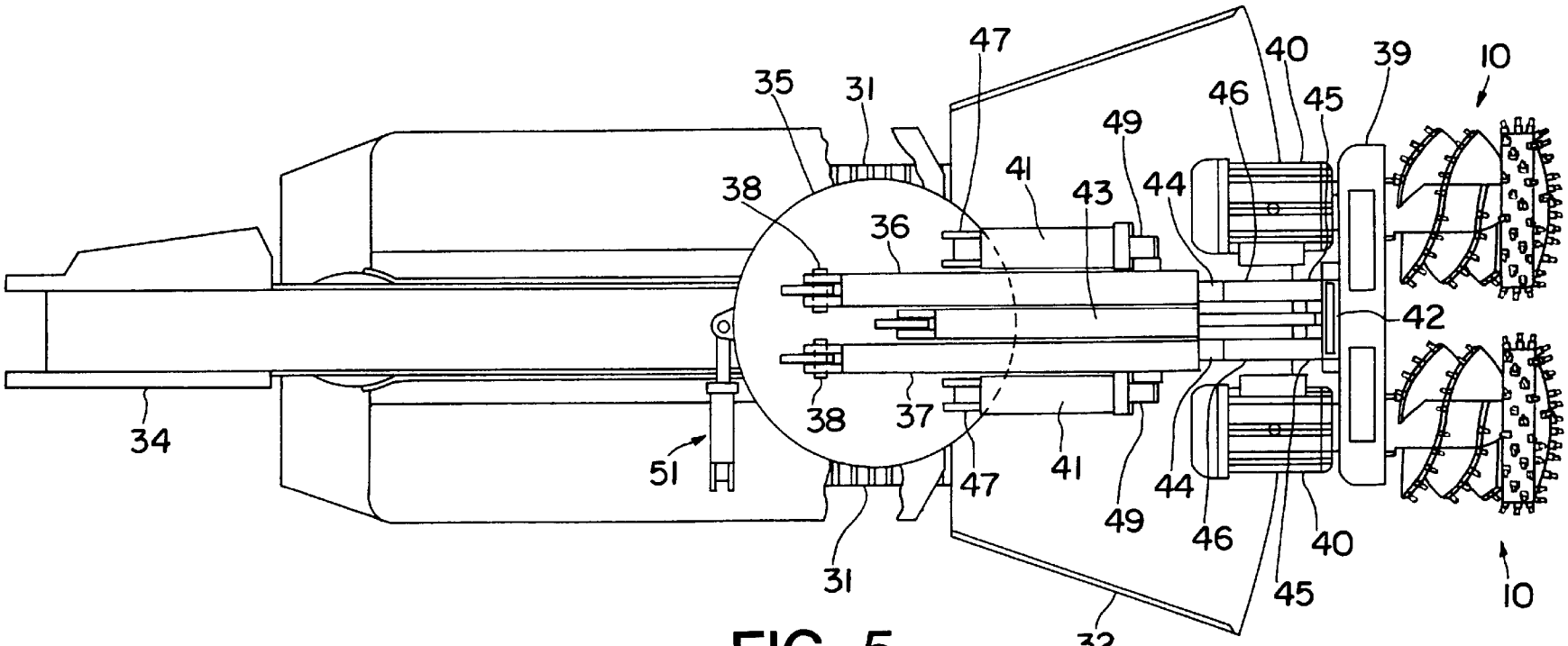
FIG. 5 is a plan view of the assembly of FIG. 4.
Figure 6:
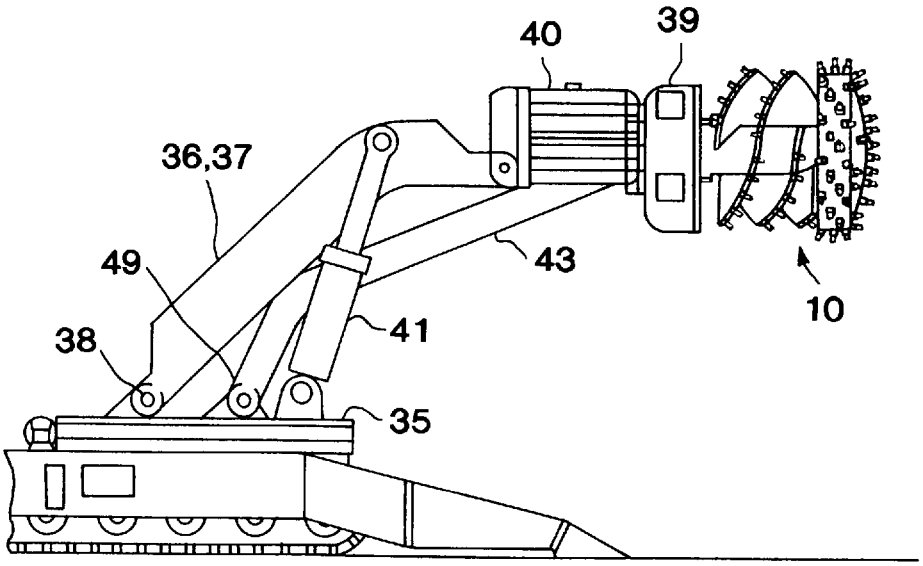
FIG. 6 is a side view of the cutting tool together with mounting means according to the present invention.
Figure 7:
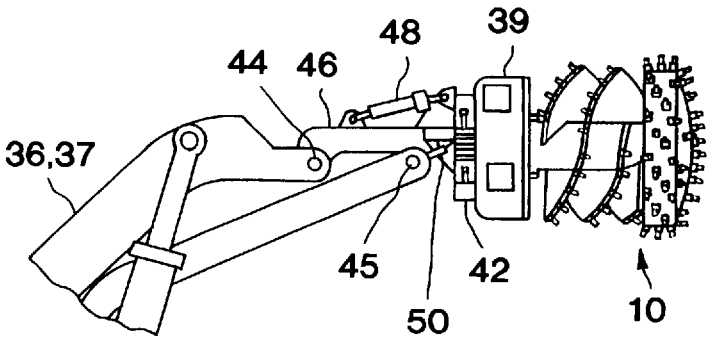
FIG. 7 is a side view of the cutting tool together with a portion of mounting means, with the electric motors not shown.

Another embodiment of the cutting element with the boring tool engaged is illustrated in FIG. 3(*a*) and the front view in FIG. 3(*b*). The cutting element 20 consists of shearing segments 21 mounted on boring arms 21*a* and one or more helical shearing flights 27 mounted on the barrel 28. The boring arms 21*a* are attached to pins 24 mounted on to the barrel 28 near the core cutter 23 located at the front of the barrel 28. Cutting bit assemblies 19 are mounted on the peripheries of the shearing segments 21 and on the helical shearing flights 27. Cutting bit assemblies 19*a* are mounted on the front of the boring arms 21*a* and on the front of the core cutter 23. The boring arms 21*a* are attached to the swing cylinders 29 with pins 25 and the swing cylinders 29 are attached to the barrel 28 with pins 15*a*. When the swing cylinders 29 are retracted as shown in FIG. 3(*a*), the boring arms 21*a* and the core cutter 23 are engaged and the cutting element 20 is configured for a boring operation. As the cutting element 20 is rotated and advanced, bit assemblies 19*a* bore out rock which passes through openings 9 to the helical flights 27 which extract rock cuttings toward the rear of the barrel 28.

The side view cross section of this embodiment of a cutting tool with the boring arms 21*a* and the core cutter 23 disengaged is illustrated in FIG. 3(*c*) with the swing cylinders 29 extended and the cutting element 20 configured for a shearing operation. In this configuration the boring arms 21*a* and the core cutter 23 are hidden inside the shearing segments and the cutting bit assemblies 19*a* are not in contact with rock, to assure no interference with the shearing operation. As before, the magnitude of the angle $\alpha$ depends on the hardness of the rock. The harder the rock, the lower the angle $\alpha$.

Referring to FIGS. 4, 5, 6 and 7, cutting elements and booms according to the present invention are mounted on a typical mining machine 7, which includes a frame 33, traction means 31, conveying means 34 and rock loading means 32. Booms 36, 37, and 43 are mounted with pins 38 on a conventional turntable 35 with swing means 51. Lifting means 41 are attached to the turntable 35 with pins 47 and to the booms 36 and 37 with pins 49. Booms 36, 37 and 43 are attached to beams 46 with pins 44 and 45 in such a way that the turntable 35, the booms 36, 37, 43 and the beams 46 form a parallelogram. A bearing 42, which carries a gearbox 39, is attached to the beams 46 with pins 50. An actuator 48 is pivotally attached to the gearbox 39 and to the beams 46. The gearbox 39 carries electric motors 40 and the cutting elements 10. As the lifting means 41 extend of retract, the booms 36, 37, and 43 lift or lower beams 46 while maintaining their position parallel to the turntable 35. The position of the gearbox 39 and the cutting elements 10 with respect to the beams 46 can be changed within a predetermined range by extending or retracting the actuator 48.

Figure 8:
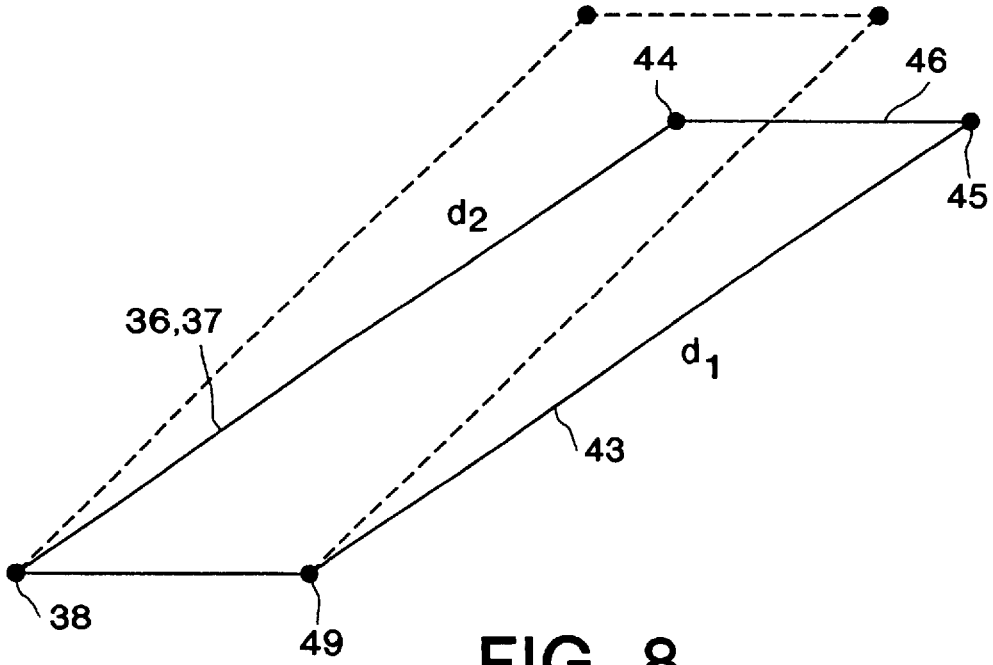
FIG. 8 is a schematic view showing the parallelogram motion of the mounting means used in the embodiment of FIG. 6.

Referring to FIG. 8, since the distance $d_1$ between pivot pin 49 and 45 is fixed, and since the distance $d_2$ between pivot pins 38 and 44 is also fixed, rotation of the booms 36, 37 and 43 and the beams 46 will cause the cutting elements 10 to swing up or down and maintain their position parallel to the turntable 35, or other position set by the actuator 48.

Numerous modifications and adaptations of the present invention will be apparent to those skilled in the art and it is intended to cover by the following claims all such modifications and adaptations which fall within the true spirit and scope of the invention.

What is claimed is:

1. A method of cutting rock in a heading where, as a first step of each excavation cycle, boring a first and a second open surface to a predetermined depth in a face of the heading utilizing a single cutting means configured as a boring means and, as a second step of the excavation cycle, shearing the heading to the predetermined depth utilizing the single cutting means reconfigured as a shearing means.

2. The method according to claim 1, wherein the single cutting means is reconfigured as the shearing means by retracting a boring element from a shearing element.

3. A cutting element for excavation of rock comprising both boring means and shearing means, wherein the cutting element can be remotely reconfigured to be the boring means for a boring operation and as the shearing means for a shearing operation.

4. A cutting element for excavation of rock as per claim 3, wherein the boring means contains openings for passage of rock cuttings away from a rock face.

5. A cutting element for excavation of rock as per claim 3, wherein the boring means is axially retractable away from the shearing means.

6. A method of rock cutting in a mining operation in which a face is defined by a substantially vertical surface, comprising the steps of:

boring into the face to a predetermined boring depth with a single cutting means configured as an axially advancing boring means; and shearing the face with the single cutting means reconfigured as a laterally movable shearing means to form a new face spaced inwardly of an original face by a distance corresponding substantially to the predetermined boring depth.

7. A method according to claim 6, wherein the shearing step includes moving the shearing means from side to side, up and down.

8. A method according to claim 6, wherein the boring means is retractable from the shearing means.

9. A method of rock cutting in a mining operation in which a face is defined by a substantially vertical surface, comprising the steps of:

boring into the face to a predetermined boring depth with an axially advancing boring means;

retracting the boring means from a shearing means; and shearing the face with the shearing means, the shearing means moving laterally to form a new face spaced inwardly of an original face by a distance corresponding substantially to the predetermined boring depth.

10. A method according to claim 9, wherein the shearing step includes moving the shearing means from side to side, up and down.

* * * * *